United States Patent [19]

Hodgins

[11] 4,048,931

[45] Sept. 20, 1977

[54] STYLE LOOP FORMING AND ATTACHING APPARATUS

[75] Inventor: Howard A. Hodgins, Pittsford, N.Y.

[73] Assignee: The Rochester Button Company, New York, N.Y.

[21] Appl. No.: 725,426

[22] Filed: Sept. 22, 1976

[51] Int. Cl.[2] ..... D05B 23/00

[52] U.S. Cl. ..... 112/121.27; 112/104; 112/130; 112/152

[58] Field of Search ..... 112/121.27, 121.26, 112/121.15, 130, 152, 104, 121.12, 147; 223/37; 270/61 R; 156/556, 558, 538, 539, 521

[56] References Cited

U.S. PATENT DOCUMENTS

| | | | |
|---|---|---|---|
| 3,699,907 | 10/1972 | Anderson et al. | 112/121.27 |
| 3,792,672 | 2/1974 | Friedman et al. | 112/152 X |
| 3,841,247 | 10/1974 | Off et al. | 112/121.27 |

OTHER PUBLICATIONS

AMF Apparel Equipment SABL; dated Sept. 26, 1975.

AMF Apparel Equipment in Automation; dated Sept. 26, 1975.

*Primary Examiner*—H. Hampton Hunter

*Attorney, Agent, or Firm*—Brumbaugh, Graves, Donohue & Raymond

[57] ABSTRACT

Apparatus forming a style loop which has one end folded over and the other end turned flat under the loop attaches the folded end and the flat end to a surface to provide the style loop which can be used, for example, as a belt loop on pants. The apparatus first folds the one end of the loop material upwardly from the surface to which the loop will be attached. The upwardly folded end is then transferred to a turning clamp which holds the folded end while the flat end of the loop is attached to the surface. The turning clamp is then moved relative to the surface to turn the loop over the attached flat end and rotated for turning the upward fold in the one end of the loop downwardly toward the surface for attachment.

16 Claims, 3 Drawing Figures

STYLE LOOP FORMING AND ATTACHING APPARATUS

FIELD OF THE INVENTION

The present invention relates generally to apparatus for forming and attaching loops of material to articles such as pants or the like, and in particular to improved apparatus for forming and attaching style loops to such articles.

BACKGROUND OF THE INVENTION

Loops of generally strip material are attached to the surface of many different types of articles. Belt loops on pants are one example for which the present invention has particular utility, but loops on other articles such as handbags could also be formed in the way described herein.

Different types of belt loops are typically used on different types of pants. One type of loop which is often used on casual pants such as blue jeans has both ends of the loop material folded over and attached to the pants in suitably spaced relation through the folded ends. Apparatus for forming this type of loop is disclosed in U.S. Pat. No. 3,699,907 which is assigned to the Duplan Corporation of which the instant assignee, The Rochester Button Co., is a division. The apparatus described in this patent folds over both ends of the loop and then transfers the folded loop to sewing apparatus such as a bar tacker which sews through each folded end of the loop and the garment to attach the loop to the garment with both ends of the loop folded under. One end of the loop can also be left unfolded and sewn to the garment without being turned under the loop. Inasmuch as each folded-under end is covered by the loop itself, however, the patented apparatus cannot sew only the flat underpart of one end of the loop to the garment.

The type of loop having one end folded over and sewn to a garment through the fold but the other end turned under the loop and sewn to the garment only through the flat end under the loop is sometimes referred to in the trade and is described herein as a style loop. The style-type loop is preferred for less casual pants such as slacks. There has thus long been a demand for apparatus which can form the distinct type of style loop and attach it to a surface.

One device which can form style loops and attach them to pants is identified by the manufacturer, AMF Incorporated, as a Semi-Automatic Belt Loop Machine (SABL). This machine requires short strips of loop material which are pre-cut to the length for the loops to be attached to the pants. Each individual loop-strip is placed upside down in a feed channel which is parallel to and (inconveniently) underneath the arm of a sewing machine. One end of the loop-strip is fed from the channel to the needle for sewing to the pants. The pants are then shifted to the position for sewing the other end of the loop, and at the same time a plate under the feed channel engages the loop to turn it over the already sewn end until the free end of the loop flips from its rearward, upside down position in the channel to a forward, rightside up position with an end portion of the loop overhanging the end of the plate. A wiper then extends downwardly across the end of the plate and inwardly thereof to fold the free end of the loop about the plate for sewing to the pants through the folded end.

The machine just described is only semi-automatic in that it requires each individual pre-cut loop-strip to be fed into the machine by hand. These strips must be placed under the sewing arm so that an unskilled operator would have to peer around the sewing head and arm in order to find the place for inserting the individual loop-strips. The operation of the device, moreover, folds the folded-over end of the loop only after the flat end of the loop has been attached to the pants so that the maximum speed with which it can complete a loop includes the time for both sewing the loop to the pants and folding over the one end. Finally, it does not appear that the machine positively engages the loop at all times in folding over the one end of the loop, but rather requires some resiliency in the loop material during the folding operation so that the one end will flip over for wiping about the plate to form the fold.

SUMMARY OF THE INVENTION

It is therefor an object of the invention to provide apparatus for forming and attaching a style loop to a surface which is more fully automatic to thereby further reduce the skill required of an operator.

It is a further object to provide an automatic machine for forming and attaching style loops which includes apparatus for cutting loop lengths as they are required so that this operation does not have to be separately coordinated with attaching the loops. This is particularly important where the loop material is to match a variety of materials for different batches of garments.

It is a further object to provide apparatus for forming and attaching style loops which folds the one folded end of a style loop independently of the rest of the apparatus so that the fold in one loop can be formed while a precedingly folded loop is being attached to the surface.

It is a still further object to provide preferred apparatus which holds the loop while it is folded so that materials of limited resiliency can be used if desired.

To this end and in accordance with the invention, improved apparatus is provided to form and attach style loops to a surface. A folding device engages and folds the one folded end of the loop for subsequent transfer to the remaining part of the apparatus. The remaining part of the apparatus includes a turning clamp which receives the folded end of the loop and holds it while attaching means attaches the other, flat end of the loop to the surface. The turning clamp and surface then move relative to each other to turn the loop over the attached flat end, whereupon the folded end is attached to the surface through the fold. A style loop having one folded end attached to the surface through the fold and the other end turned under the loop and attached to the surface only through the flat, turned-under end of the loop has thus been formed and attached to the surface.

The turning clamp also cooperates with the folding means so that the fold in the one end of the loop is downward toward the surface when the loop is positioned for attaching the folded end. In the preferred embodiment, this is done by first folding the one end of the loop upwardly from the surface, transferring it to the turning clamp, and then rotating the turning clamp to orient the fold downwardly toward the surface in synchronism with the relative movement of the turning clamp and surface which turns the loop over the already attached, flat end of the loop. It will be appreciated, however, that the precise structure of the preferred embodiment for orienting the folded end downwardly toward the surface is not essential to the invention, so that, for example, another embodiment may fold the loop upwardly and then further curl the loop until the fold extends downwardly toward the surface whereby the relative movement between the turning clamp and surface will properly orient the folded end with the fold downward toward the surface for attachment.

As thus described, the apparatus has separate structures for, on the one hand, folding the one end of the loop and, on the other hand, attaching the flat end of the loop, turning the loop over the attached flat end, and attaching the folded end of the loop. By having the end-folding device separate from the rest of the loop forming and attaching structure, the apparatus permits the end of one loop to be folded while a previously folded loop is being attached to the surface. The separate folding and attaching operations permit the time for completing each loop to be reduced by the time required for folding the one end of the loop as compared to a machine of the type described as known for forming style loops in which the fold is formed only after one end of the loop has been attached to a garment.

The turning clamp is important to these operations to hold the folded end of the loop while the other, flat end is being attached to the surface. If the folded end were not held, the fold might resiliently unfold with some loop materials or, if not held properly, might be angularly shifted from its desired alignment with the length of the loop. The preferred turning clamp therefore has jaws for holding the fold and structure for opening and closing the jaws generally parallel to each other to avoid angularly displacing the ends of the loop.

In the preferred embodiment, the folding device comprises a pair of spaced tines which rotate from a position straddling one end of the loop to a position which folds over the end and holds it folded about the tines. The turning clamp then engages the fold, following which separating movement between the clamp and tines slips the fold off the tines while holding it in the clamp until it is ready for attachment to the surface. The fold is thus positively held from the time of its formation until it is attached to the surface even though the fold is formed before either end of the loop is attached to the surface. The positive loop-folding of the preferred structure also operates independently of any resiliency of the loop material which may be needed to flip over an end of the loop with the described known style loop forming machine.

The preferred embodiment also includes structure operative with the folding device for automatically cutting each individual loop length from a longer piece of loop material and for holding the flat end of the loop until it is attached to the surface. This structure further cooperates with the positive holding of the folded end so that the whole apparatus may be fully automatic. An operator then need only insert the surface to receive the loop, such as a pair of pants, and the apparatus will thereafter cut, fold, turn and attach a style loop.

DESCRIPTION OF THE DRAWINGS

A preferred embodiment which is intended to illustrate and not to limit the invention will now be described with reference to drawings in which.

DESCRIPTION OF THE PREFERRED EMBODIMENT

Figure 1:
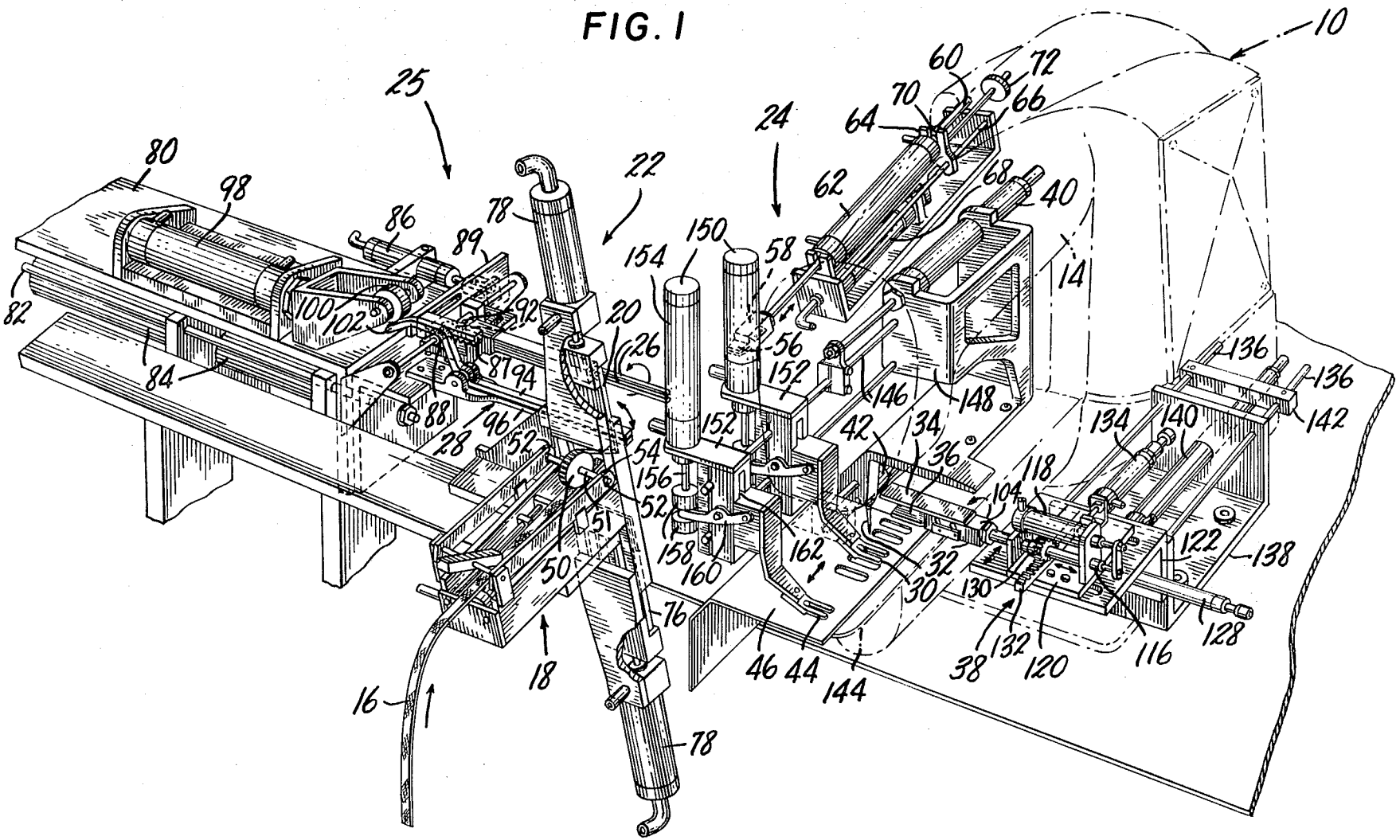
FIG. 1 is an isometric view of the preferred embodiment.

FIG. 1 shows the preferred embodiment of apparatus for forming a style loop in relation to a sewing machine 10 (in phantom) which attaches the ends of the loop to a surface such as the waist band 12 (FIG. 3) of a pair of pants. The sewing machine may be any of a number of known types; a model 269 bar tacker made by Singer Company is preferred. A bar tacker is a sewing machine which is adapted to automatically sew a predetermined distance transverse to arm 14 of the sewing machine. The machine is usually arranged to form large or tacking stitches over the predetermined distance while sewing in one direction and then to sew with a smaller stitch while retraversing the predetermined distance in the opposite direction. For use with the present invention, the predetermined distance sewn by the bar tacker is set to or slightly less than the width of loop material 16 which will be sewn to the pants. In other embodiments of the invention, however, other attaching devices such as a riveter may be used in place of the sewing machine.

The loop material 16 extends through a guide at 18 to a cutting blade 20 of a guillotine-action cutter at 22. A pincher 24 advances to the end of the loop material at the cutter, grips the end of the loop material, and retracts to pull a loop length of the material through the cutter. Loop folding apparatus at 25 then advances until a pair of tines 26 and a scissor-action gripper 28 each straddle the loop material, the gripper then being open (not shown). The pincher then opens to release the end of the loop material upward (counterclockwise) about the tines. The gripper also closes on the loop material and the cutter cuts the loop length from the rest of the loop material.

The folding device then advances toward the sewing machine to position the end of the loop at the gripper under a presser foot 30 which is aligned with needle 32 of the sewing machine. This advancing movement of the folding device also positions the folded end of the loop length (L in FIG. 3) on tines 26 between jaws 34, 36 of a turning clamp at 38. The jaws of the turning clamp then close on the folded end of the loop and, upon opening the gripper 28, the folding device retracts to slip the tines 26 from the folded end of the loop which remains held between the jaws of the turning clamp and to leave the flat end of the loop which was advanced by the gripper under the presser foot 30. The sewing machine then sews the flat end of the loop to the surface (waistband 12 shown only in FIG. 3).

Figure 3:
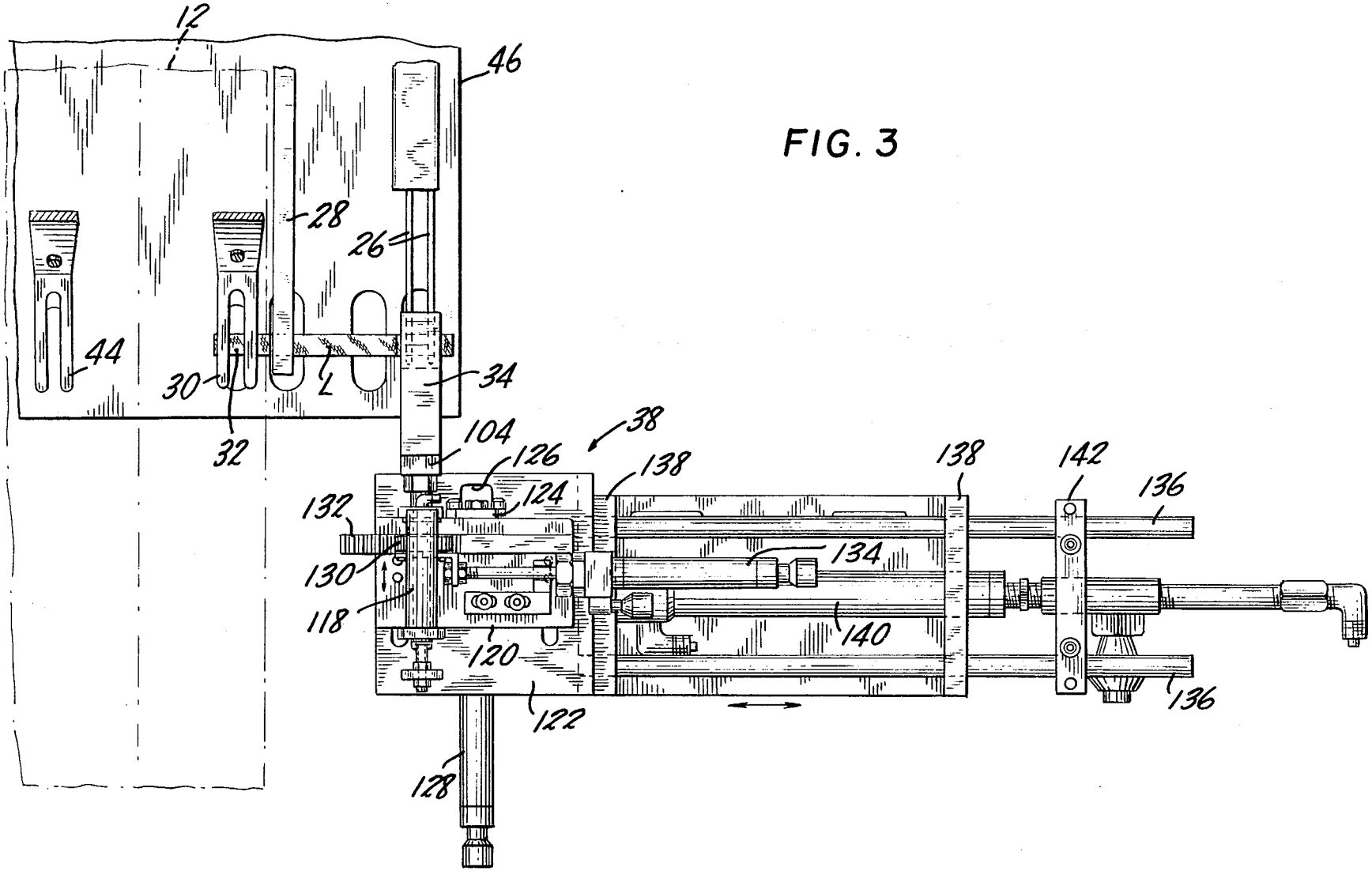
FIG. 3 is a plan view of the turning clamp shown in FIG. 2 in operative relation with other portions of the embodiment shown in FIG. 1.

The preferred sewing machine has a threaded cutter which automatically cuts the thread (not shown) when the sewing machine has finished sewing the flat end of the loop to the pants. In the preferred embodiment, however, activation of the thread cutter also activates piston and cylinder devices 40 and 42 which move the presser foot 30 (and an adjacent presser foot 44) and a plate 46 which supports the waistband 12 (FIG. 3). The movement of the plate 46 moves the waistband 12 (FIG. 3) on the plate and the end of the loop which has been sewn flat to the waistband to space the already sewn flat end of the loop from the location on the waistband for sewing the other, folded end of the loop. At the same time, the turning clamp 38 advances to the presser foot 44 which is then positioned at the needle and rotates to orient the fold in the loop downward toward the surface. The turning clamp then moves outwardly (to the right in FIG. 1) as the jaws 34, 36 open and the presser foot 44 lowers to leave the folded end of the loop under the presser foot 44 for sewing to the surface. A complete style loop has then been formed and attached to the surface (waistband 12 in FIG. 3) with one end folded over and sewn to the surface through the folded end and the other end turned under the loop and sewn flat to the surface.

The foregoing general description of the preferred embodiment shows that structure has been provided to perform each operation for forming and attaching a style loop to a surface. The operation of the preferred embodiment can therefore be made automatic by sequencing the operation of the different parts of the structure in any of the several well-known ways. In the preferred embodiment, this sequencing is done fluidically with fluid control devices arranged to activate the fluid activators (piston and cylinder devices) for each part of the apparatus. Suitable fluidic control devices are commercially available from the Corning Glass Co. and the fluid activators are preferably provided with controlled pressure release devices (also commercially available) so that the full fluid pressure of the system drives the actuators regardless of the speed at which the devices permit them to operate. For clarity of illustration, the fluid lines, fluidic control devices, pressure release devices and other components conventionally employed with fluidic systems are not shown in the drawings. It will be understood, however, that such equipment would be provided in the actual embodiment. Electronic controls and electric activators or cam controls and mechanical activators or any combinations thereof, all of which are within the design skill of those in the art, may, however, be used on other embodiments which are within the scope of the invention.

THE FEEDING AND CUTTING DEVICES

The guide 18 which directs the loop material to the cutter includes an idler wheel 50 which is rotatably mounted on a shaft 51 which extends into slightly elongated slots 52 on opposite sides of the guide. The idler wheel 50 rolls along the loop material as it is pulled from the guide by the pincher 24 and moves up and down in the slots with variations in the thickness of the loop material. A bore 54 extends through the guide to the top of one of the slots 52 so that upward movement of the idler wheel 50 as it rolls over a thicker part of the loop material will cause shaft 51 to rise up to and block the opening of the bore 54 into the slot.

In the garment industry, the loop material for belt loops on pants is made by sewing together scraps and other small pieces of the fabric from which the pants were made. The sewn together pieces are folded about a lining or stiffening tape and sewn together longitudinally along the tape to form the loop material. The longitudinal seam along the loop material will be positioned as the underside of the finished loop, but the seams between successive pieces used for forming the loop extend around the loop material and would therefore show in a belt loop. Loop lengths which include a seam between successive pieces of the material are therefore discarded.

The seams between successive parts of the loop material are thicker than the rest of the loop material. When the idler wheel 50 rolls over the thicker seam, the shaft 51 moves up to the bore 54 to block the bore. The bore 54 may therefore be connected to a fluidic control which responds to blocking the bore to detect loop lengths which should be discarded because they include a seam extending around the loop material. (Fluidic controls of this type are well-known and commercially available from the Corning Glass Company.) A signal from the fluidic device then resequences the apparatus so that the cutter 22 cuts the loop length having the seam from the rest of the loop material and the pincher 24 opens, but the folding device does not advance to straddle the loop length so that the cut loop length falls from the apparatus and is thereby discarded. The normal operation of the cutting and folding devices then begins again with the pincher advancing to the cutter to pull another loop length through the guide.

Those in the art will recognize that the structure just described for detecting overly thick portions of the loop material is merely exemplary of one such detector. A microswitch and electronic controls could, for example, be substituted for the bore 54 and fluidic controls of the preferred embodiment. Another variation of the preferred embodiment may include similar detectors for detecting exceptionally thin or absent loop material. These variations are within the scope of the invention.

For feeding the loop material from the guide, the pincher 24 has a pair of pincher jaws 56. The pincher jaws are connected to a piston and cylinder device 58 which is adapted to open and close the jaws for pinching the end of the loop material. The piston and cylinder device 58 is supported by and supplied with fluid pressure through a hollow rod 60. The rod 60 is further adapted as the piston of another piston and cylinder 62 which is mounted on a carriage 64. The carriage 64 is adapted to slide along rods 66 (only one shown) and connected to another piston and cylinder device 68 which is arranged for moving the carriage along the rods. A stop member 70 is adjustably positionable along the rod 60 and another stop member 72 is adjustably positioned along a projection of the carriage 64. All the structure associated with the pincher is inclined at an angle of about 30° from the end of the loop material in the guide 18 which supports the loop material just slightly above the plane of the plate 46.

The cutter 22 has a frame 74 which extends generally vertically as shown in FIG. 1. The frame has a channel which receives the cutting blade 20 and a anvil blade 76. The blades are generally spaced apart above and below the loop material in the guide 18, but each is connected to piston and cylinder devices 78 which move the blades along the channel until they cooperate in cutting the loop material.

In operation of the pincher and cutter, both piston and cylinder devices 62 and 68 first advance the pincher with its jaw 56 open until the jaws reach the end of the loop material, stop member 72 being positioned for this purpose. The piston and cylinder 58 then closes the pincher jaws 56 on the end of the tape and one of the piston and cylinder devices 62, 68 retracts the pincher to pull a loop length of material through the cutter, the loop length being adjustably determined by the position of the other stop member. The folding device then advances to straddle the loop length of the loop material with the tines 26 and gripper 28. As the tines 26 rotate to fold over the one end of the loop, piston and cylinder device 58 opens the pincher jaws 56 to release the end of the loop for folding about the tines. The gripper 28 holds the other end of the loop as piston and cylinder devices 78 move the blades of the cutter to cut the loop to length.

THE FOLDING DEVICE

The folding device comprises a carriage 80 which is movable along rods 82 (only one shown) by a pair of piston and cylinder devices 84 each having adjustable stop members (not shown) associated therewith for adjustably presetting the stroke of the movement of the carriage 80 by each of the piston and cylinder devices 84. One piston and cylinder device 84 is thereby adapted to advance the tines 26 and gripper 28 on the carriage 80 to straddle the loop length when it is pulled from the guide by the pincher as just described.

To rotate the tines 26, a piston and cylinder device 86 is mounted on the carriage 80 and connected to a rack 87 through a bracket 89. The rack engages a pinion 88 on a shaft 90 which is rotatably mounted on the carriage. One of a pair of bevel gears 92 is journaled to the shaft and the other is connected to the tines. Operation of the piston and cylinder device 86 then moves the rack to rotate the pinion and bevel gears to rotate the tines. This structure is arranged to rotate the tines counterclockwise (as viewed in FIG. 1) about a $\frac{3}{4}$ turn so that the tines rotate from a position straddling the loop and generally normal to plate 46 to a position generally parallel to the loop and plate 46. The end of the loop is thus folded about the tines and held in the folded position by the tines.

The gripper 28 has a pair of scissor-action gripper jaws 94, 96. Jaw 96 is fixed to the carriage 80, but jaw 94 is pivotally mounted thereon for the opening and closing scissorlike action with operation of still another piston and cylinder device 98 which is also mounted on carriage 80. The piston and cylinder device 98 moves a camming wheel 100 which is arranged in cooperation with a cam surface 102 for opening and closing the gripper jaws 94, 96.

The precise cam and cam follower structure shown in FIG. 1 for operating the gripper jaws is illustrative only, and it will be understood that any other cam and cam follower arrangement suitable for operating a scissor-action gripper may be employed. For example, one such arrangement might have a stationary cam surface adjacent the cutter and a camming member which is adapted to also move normally to the action of piston and cylinder device 98 as the piston and cylinder device moves it along the cam surface to hold the gripper jaws 94, 96 closed with the force of the piston and cylinder device 98. This arrangement has the advantage of more positively gripping the loop. As shown in FIG. 1, the gripper jaws are normally biased to close on the loop by a spring (not shown). The cam surface 102 of the gripper jaw 94 cooperates with movement of the camming roller 100 to open the gripper jaws.

After the tines 26 have rotated to fold one end of the loop about the tines and the gripper 28 has closed on the loop to hold the other end flat, the other of piston and cylinder devices 84 advances carriage 80 to carry the loop to the sewing machine. (At the same time, the other of piston and cylinder devices 62, 68 associated with the pincher further retracts the pincher to get it out of the way of the advancing movement of the folding device.)

The folding device, like the pincher, is tilted about 30° to the plate 46 with the gripper 28 just above the surface of the plate so that the gripper slips the end of the loop which was just cut by the cutter under the presser foot 30 but over the waistband surface as shown in FIG. 3. The tines 26 are generally aligned with the jaws 34, 36 of the turning clamp but spaced above the surface on the plate 46 by the inclination to deliver the folded end of the loop between the jaws of the turning clamp.

THE TURNING CLAMP

Figure 2:
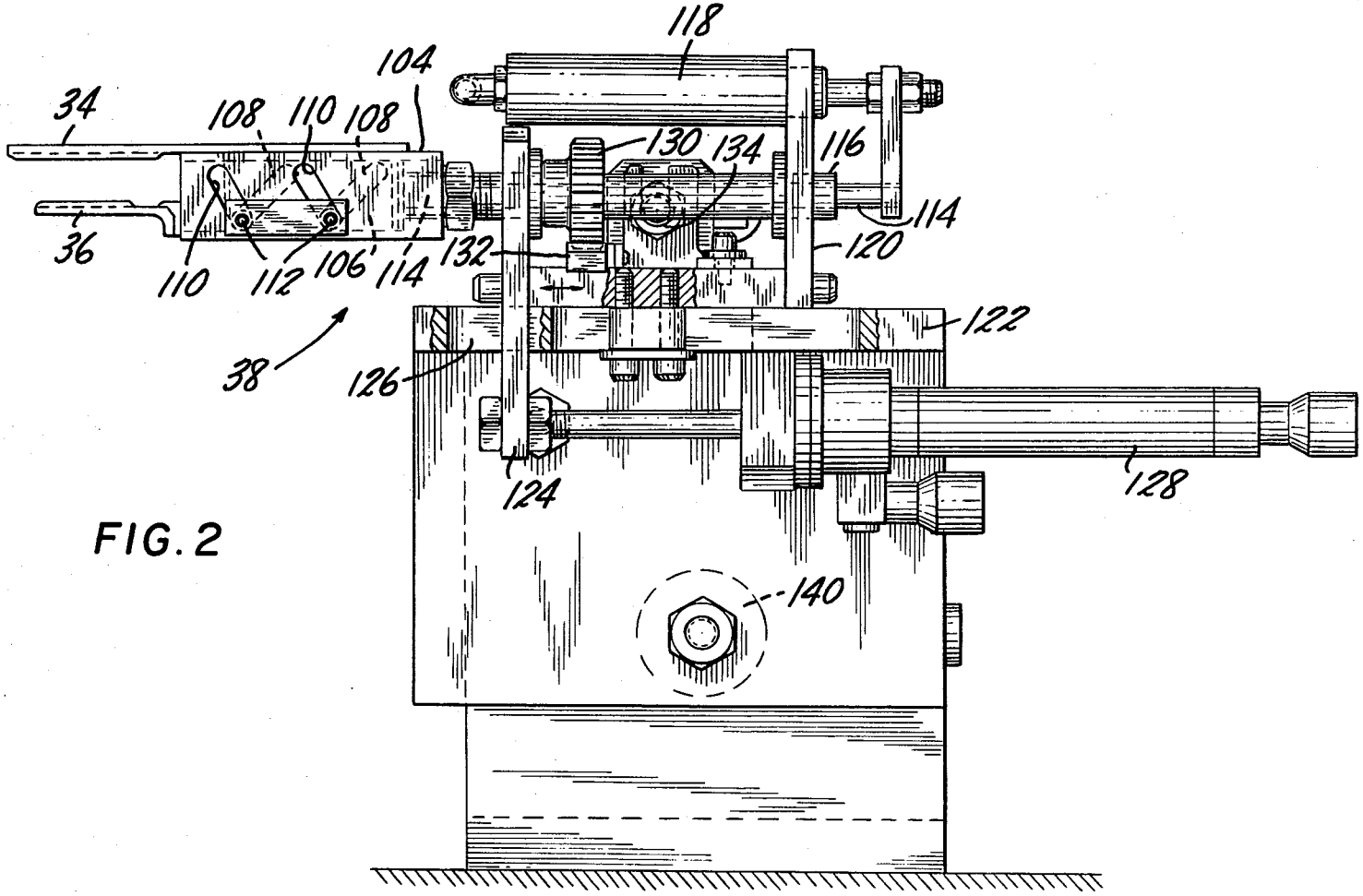
FIG. 2 is an elevation of a turning clamp of the preferred embodiment shown in FIG. 1.

Turning clamp jaw 34 projects from a hollow outer member 104 which supports an internal member 106 within it as shown in FIG. 2. The inner and outer members each have a pair of slots, 108, 110, respectively, which extend at equal but opposite angles to cross each other. A portion of jaw 36 extends into a groove (not shown) within the inner member 106 which intersects the slots 108 in the inner member. A pair of pins 112 projects from the portion of the jaw 36 within the inner member into the slots 108 in the inner member to movably support jaw 36 on the inner member. The pins also extend into the slots 110 in the outer member. The sides of the slots 108, 110 form cam surfaces for the pins 112. Movement of the inner member along the outer member then forces the pins along the cam surfaces to thereby move jaw 36 generally parallel to the jaw 34.

The inner member is moved within the outer member by a plunger 114 which extends through a hollow shaft 116 and is free therein for movement along the shaft but rotates with the shaft as later described. The end of the plunger 114 remote from the jaws projects from the shaft 116 and is connected to piston and cylinder device 118. The piston and cylinder device 118 is therefore adapted to move the inner member 106 along the outer member 104 to open and close the jaws 34, 36 of the turning clamp generally parallel to each other.

The shaft 116 and the piston and cylinder device 118 are mounted on a bracket 120 which is slidingly supported on one end of a carriage 122. A portion 124 of bracket 120 extends through a slot 126 in carriage 122 which extends toward the sewing machine. The portion of the bracket which extends through the slot is connected to a piston rod of piston and cylinder device 128, the cylinder of which is connected to the carriage. The action of the piston and cylinder device 128 therefore moves the jaws of the turning clamp toward and away from the sewing machine.

The shaft 116 has an external pinion 130 which engages a rack 132 which is slidingly supported on the bracket 120. With reference now to FIG. 3, the rack 132 is seen to be connected to another piston and cylinder device 134 which is mounted on the bracket 120 so that operation of the piston and cylinder device 134 moves the rack relative to the bracket to rotate pinion 130. Rotating pinion 130 rotates shaft 116. Shaft 116 is connected at one end to the outer member 104 of the turning clamp to rotate the jaws of the turning clamp (and plunger 114).

The carriage 122 has a pair of rods 136 which extend through spaced portions of a frame 138 to support the carriage. A piston and cylinder device 140 is connected to the carriage as shown in FIG. 2 to move the carriage along the frame as indicated by the arrow in FIG. 3 until a stop member 142 which is adjustably positioned along the rods 136 engages the frame 138. The stop member 142 is positioned along the rods 136 so that the movement of the carriage will move the jaws of the turning clamp from the position shown in FIG. 3 in which they are generally aligned with the tines 26 to a position proximate the needle 32 of the sewing machine.

FIGS. 2 and 3 also show that the jaws of the turning clamp are generally aligned with the tines 26 so as to grip and hold the fold in the one end of the loop with the spacing and tensioning imparted to the loop by the feeding and folding when the jaws close generally parallel to each other and also that the facing surfaces of the jaws are disposed generally parallel to plate 46 and rotated tines 26 when the fold is received. The jaws therefore are adapted to be closed on the fold while it is held by the tines and thereafter hold the fold as the tines are slipped back from the fold and jaws.

THE SEWING MACHINE

The sewing machine 10 has a sewing bed 144 on which the plate 46 is slidingly supported as shown in FIG. 1. A pair of rods 146 slidably extend through spaced portions of a frame 148 at one end. The other end of rods 146 support a pair of presser foot actuators 150 in spaced relation to each other. At least one of the rods 146 is connected to the piston and cylinder device 40 so that the action of the piston and cylinder device 40 moves the rods and the connected presser feet actuators along the arm 14 of the sewing machine.

One presser foot actuator raises and lowers presser foot 30 and the other raises and lowers presser foot 44, but both presser feet actuators are the same so that only one need be described. A bracket portion 152 of the actuator associated with presser foot 44 is connected to the rods 146. The cylinder 154 of a piston and cylinder device is connected to the top of bracket portion 152 so that the piston rod part 156 of the piston and cylinder device extends downwardly toward the plate 46. A pair of spaced lugs 158 on the piston rod receive between them one arm of a bell crank 160 which is pivotally connected to the bracket portion 152 of the actuator. The other arm of bell crank 160 is rotatably connected to an upper portion of presser foot 44 which is also slidingly received within a channel 162 in the bracket portion of the actuator. Operation of the piston and cylinder device then pivots bell crank 160 to raise and lower presser foot 44.

OPERATION OF THE PREFERRED EMBODIMENT

Having now described the entire preferred embodiment, its total operation may be reviewed. Beginning with FIG. 1, the piston and cylinder devices 62, 68 first extend the pincher 24 to the end of the loop material 16 at the cutter 22. Pincher jaws 56 on the pincher close on the end of the loop material and the pincher retracts far enough to pull a loop length of the material through the cutter. If a portion of the loop material which is too thick is detected by movement of detector wheel 50, the cutter 22 cuts the loop length from the loop material and the pincher jaws 56 open to drop the loop length, but if no portion of unacceptable thickness is detected, the pincher jaws 56 continue to hold the end of the loop material while one of the piston and cylinder devices 84 advance the tines 26 and gripper 28 to straddle the loop length. The cutter then operates as the tines 26 rotate to fold one end of the loop upwardly about the tines and the gripper 28 closes to hold the cut end of the loop.

The folding device then advances to slip the cut end of the loop adjacent the gripper under presser foot 30 and position the folded end of the loop between the jaws 34, 36 of the turning clamp. Piston and cylinder device 118 then closes the jaws of the turning clamp to hold the folded end of the loop and the presser foot actuator 150 associated with presser foot 30 lowers the presser foot on the cut end of the loop. The cut end of the loop is then sewn flat to a surface such as waistband 12 (FIG. 3) of a pair of pants which was placed on plate 46 before the loop was advanced to the sewing machine.

Piston and cylinder device 140 then moves the turning clamp toward the needle 32 to turn the loop over the end which has just been sewn flat to the surface and piston and cylinder device 134 rotates the turning clamp in the same direction to orient the upward fold in the loop downward toward plate 46 and the waistband surface thereon. (Inasmuch as the loop is turned over the already sewn, flat end, the loop material is fed into guide 18 upside down so that, once turned, it is rightside up.)

Along with the turning clamp movement, piston and cylinder device 42 retracts plate 46 and the pants waistband thereon so that the end sewn flat is spaced from the needle 32. Piston and cylinder device 40 also moves the presser feet so that presser foot 44 is at the needle. Presser foot 44 is then lowered by its actuator onto the folded end of the loop as the jaws of the turning clamp are opened by piston and cylinder device 118 and retracted by piston and cylinder device 128. The folded end of the loop under presser foot 44 is then sewn to the waistband through the folded end. The plate 46 and the turning clamp 38 preferably move about equidistantly so that the loop is turned generally flat as is suitable for a belt loop on pants. A style loop having one end sewn flat to the pants, the loop turned over the flat end, and the other end folded over and sewn to the pants through the folded end has thus been formed.

In addition to the alternative embodiments specifically suggested, other alternative embodiments which will occur to those in the art are contemplated as within the scope of the claimed invention.

I claim:

1. Apparatus for forming a style loop having one end folded over and the other end turned flat under the loop and for attaching the ends of the loop to a surface, the apparatus comprising:

means adjacent the surface for attaching the ends of the loop thereto;

a turning clamp positioned over the surface;

means receiving loop material for folding over one end and for advancing the folded end to the turning clamp and the other end flat to the attaching means;

means operating the turning clamp for thereafter holding the folded end of the loop while the attaching means attaches the flat end to the surface; and means relatively moving the turning clamp and the surface for turning the loop over the attached flat end and transferring the folded end to the attaching means for attachment to the surface.

2. Apparatus for forming a style loop having one end folded over and the other end turned flat under the loop and for attaching the ends of the loop to a surface, the apparatus comprising:

means adjacent the surface for attaching the ends of the loop thereto;

a turning clamp positioned over the surface;

means receiving loop material for folding over one end upwardly from the surface and for advancing the upwardly folded end to the turning clamp and the other end flat to the attaching means;

means operating the turning clamp for thereafter holding the folded end of the loop while the attaching means attaches the flat end to the surface;

means relatively moving the turning clamp and the surface for turning the loop over the attached flat end; and means rotating the turning clamp in the same direction as the relative clamp movement for rotating the upward fold in the one end of the loop downwardly toward the surface and, in combination with the relative clamp moving means, transferring the then downwardly folded end to the attaching means for attachment to the surface.

3. Apparatus as in claim 2 wherein the turning clamp comprises a pair of jaws and the operating means comprises means for opening and closing the jaws in generally parallel relation to each other.

4. Apparatus as in claim 2 wherein the turning clamp comprises a pair of members; a jaw projecting from each member; an oppositely angled, linear cam surface on each member; and a cam follower engaging the cam surfaces of both members; and the operating means comprises means moving the members relative to each other so that the cam follower moves along the cam surfaces for opening or closing the jaws on the members generally parallel to each other.

5. Apparatus as in claim 4 wherein one of the members is supported within the other and the member moving means comprise a plunger pushing the inner member along the other, at least the jaw portion of the inner member also being movable transverse to the plunger as the cam follower moves along the cam surfaces for opening and closing the jaws generally parallel to each other.

6. Apparatus as in claim 2 wherein the means for folding over one end of the loop comprises a pair of tines for straddling the loop material at the one end and means rotating the tines for folding over the one end of the loop.

7. Apparatus as in claim 2 wherein the attaching means has only one location operative for attaching the ends of the loop to the surface and the turning clamp is spaced therefrom while it holds the folded end of the loop as the flat end is attached to the surface and wherein the means relatively moving the turning clamp and surface moves the turning clamp to the location for transferring the folded end of the loop to the attaching means and moves the surface for spacing the attached ends of the loop from each other.

8. Apparatus as in claim 7 wherein the turning clamp is spaced from the attaching location sufficiently to tension the loop while the flat end is being attached to the surface.

9. Apparatus as in claim 8 wherein the means moving the clamp and the surface move substantially equidistantly so that the loop is turned generally flat over the flat attached end, whereby the style loop is suitably shaped for a belt loop on pants.

10. Apparatus as in claim 2 additionally comprising means for feeding the loop material to the folding means.

11. Apparatus as in claim 10 additionally comprising means for cutting a loop length of the fed loop material from a longer piece of the material.

12. Apparatus as in claim 2 wherein the attaching means is a bar tacking sewing machine.

13. Apparatus as in claim 12 wherein the sewing machine has means for signalling completion of each sewing operation and wherein the relative moving means are responsive to the signalling means so as to relatively move the turning clamp and surface after the flat end of the loop is sewn to the surface.

14. Apparatus for forming and attaching a style belt loop to pants, the style loop having one end folded over and sewn to the pants through the folded end and the other end turned under the loop and sewn flat to the pants in spaced relation to the one folded end, the apparatus comprising:

a. a sewing machine for sewing the ends of the loop to the pants, the sewing machine having a needle, a plate movable along a sewing bed for receiving the pants, and at least one presser foot above the plate at the needle;

b. means for pulling a loop length of upside down material from one end of a longer piece;

c. folding means having a pair of tines and a gripper spaced from each other less than the loop length and adapted to straddle the loop length;

d. means rotating the tines for folding over the one end upwardly of the plate and closing the gripper for holding the loop;

e. means spaced from the gripper for cutting the loop length from the longer piece;

f. a turning clamp having a pair of generally parallel movable jaws adjacent the needle and above the plate of the sewing machine;

g. means for moving the folding means to the loop-straddling position and for moving the gripper-held and folded loop length thereon after it is cut to the sewing machine with the flat end of the loop slipped under the presser foot at the needle of the sewing machine and with the folded end on the tines between the jaws of the turning clamp;

h. means for closing the jaws on the folded loop end whereby retraction of the folding means with opening of its gripper leaves the folded end held in the jaws and the other flat end under the presser foot for sewing to the pants;

i. means moving the plate and the pants thereon for spacing the ends of the loop from each other;

j. means moving the turning clamp in the opposite direction from the plate for turning the folded end of the loop over the end of the loop sewn flat to the pants whereby the upside down loop material is positioned rightside up, the movement also bringing the folded end of the loop to the needle of the sewing machine, and means rotating the turning clamp for orienting the upward fold in the end of the loop between the jaws downward toward the plate and the pants thereon; and k. means opening the jaws and retracting them from the folded end of the loop for sewing through the folded end to complete the style belt loop.

15. An attachment for a sewing machine for forming a style loop which is to be sewn to a surface, the style loop having one end folded over and adapted to be sewn to the surface through the folded end and the other end turned under the loop and adapted to be sewn to the surface flat, the attachment comprising:

a turning clamp having a pair of cooperatively closable jaws above the surface which are closed on the folded end of the loop, the fold being upward from the surface and the other end of the loop being positioned flat for sewing to the surface;

means moving the turning clamp toward the flat sewn end for turning the loop over the sewn end; and means rotating the turning clamp in the same direction for orienting the upward fold downwardly toward the surface for sewing to the surface through the folded end.

16. Apparatus as in claim 15 wherein the turning clamp comprises:

an inner and an outer member from each of which one of the jaws projects;

an oppositely angled slot in each member for providing a cam surface on each member;

a pin extending into the slot in both members for movement along the cam surfaces; and means moving the members relative to each other so that the pin moves along the cam surfaces whereby the jaws also move for opening or closing generally parallel to each other.

* * * * *